United States Patent [19]

Sagawa et al.

[11] 4,035,613

[45] July 12, 1977

[54] CYLINDRICAL CERAMIC HEATING DEVICE

[75] Inventors: Nobukazu Sagawa; Yasuo Uchikado, both of Kokubu; Yoshiteru Hamano, Kyoto; Ryoichi Sugimoto, Kyoto; Sakae Mori, Kyoto, all of Japan

[73] Assignee: Kyoto Ceramic Co., Ltd., Kyoto, Japan

[21] Appl. No.: 647,356

[22] Filed: Jan. 8, 1976

[51] Int. Cl.[2] ..... H05B 3/10

[52] U.S. Cl. ..... 219/552; 219/238; 219/535; 219/541; 219/543; 219/544

[58] Field of Search ..... 219/227, 229, 238, 241, 219/242, 438, 535, 541, 543, 544, 552, 553, 218, 248

[56] References Cited

U.S. PATENT DOCUMENTS

| | | | |
|---|---|---|---|
| 428,443 | 5/1890 | Ashbaugh | 338/248 X |
| 2,366,910 | 1/1945 | Kollath | 219/238 |
| 2,727,632 | 12/1955 | Mack | 219/544 X |
| 2,838,639 | 6/1958 | Planer et al. | 338/218 X |
| 2,859,321 | 11/1958 | Garaway | 219/543 X |
| 3,126,469 | 3/1964 | Feldmann et al. | 219/543 X |
| 3,325,627 | 6/1967 | Adler et al. | 219/227 |
| 3,349,722 | 10/1967 | Davis | 219/543 X |
| 3,519,799 | 7/1970 | Bange | 219/541 |
| 3,694,627 | 9/1972 | Blatchford et al. | 219/543 |
| 3,869,596 | 3/1975 | Howie | 219/438 |

*Primary Examiner*—Volodymyr Y. Mayewsky
*Attorney, Agent, or Firm*—Spensley, Horn and Lubitz

[57] ABSTRACT

The disclosure relates to a ceramic heating device in the form of a cylindrical shape comprising a burnt cylindrical support core of heat-resistant ceramics, a ceramic element disposed around said support core, said element comprising (i) a burnt sheet of heat-resistant ceramics; (ii) a heat-generating resistor pattern, said pattern being hermetically sealed between said sheet; and (iii) a pair of exposed terminals provided onto said sheet and said core, said terminal being connected to said pattern and adapted to be coupled to power leads such that electric power is then applied to said pattern.

8 Claims, 18 Drawing Figures

CYLINDRICAL CERAMIC HEATING DEVICE

BACKGROUND OF THE INVENTION

1. Field of the Invention

This invention relates to a novel heating device comprising a burnt cylindrical support core of ceramics and heater element(s) disposed around the core in which heater element(s) and a heat-generating resistor pattern are hermetically sealed in a burnt ceramic sheet body. The support core is adapted so that articles to be heated such as an electric soldering iron and a hair curling device in which heating over cylindrical configuration is necessary are combined with the device.

2. Prior Art

Various kinds of heater elements are known in the art and are used in a wide range of heating applications. A most simple and popular heater is one provided with a nichrome wire upon an insulating body. Such a heater element provided with the nichrome wire, with its peculiar features, requires rather considerable amounts of electric power consumption. Moreover, since the nichrome wire is exposed to the air, the heating of the wire always accompanies oxidation thereof. This causes deterioration in a relatively short time. In addition, under some environments, the nichrome wire is subjected to a chemical erosion which also reduces its useful life. While heater elements using a nichrome wire as a heat-generating medium do have the advantage that they can be manufactured at a low cost and the quantity of heat produced therefrom is relatively large, breakage, oxidation, etc. are associated with its use which often outweighs its initial low cost.

Another prior art heater element uses a conductive resin as a heat-generating medium in which the heat is spread by the resin. However, the quantity of heat is reduced with these heater elements due to the comparatively low heat-resistance of the resin used which limits the applicabilities thereof. These types of heaters are further limited in their use because of their high manufacturing cost.

BRIEF SUMMARY OF THE INVENTION

One method of eliminating the defects associated with the known heating device is set forth in U.S. patent application Ser. No. 575,013 filed June 5, 1975 which is co-pending with the present application. This invention is directed particularly to heating articles in which heating over cylindrical configuration is required by combining the heater element in the former co-pending application with a cylindrical support core. This invention, therefore, represents further advantages than those set forth in Ser. No. 575,013.

In the present invention, a ceramic heating device is comprised of a cylindrical support core of heat-resistant ceramics and at least one burnt heater element of heat-resistant ceramics disposed around said core in contact with the outer or inner periphery of said support core. The support core has a hollow or solid cylindrical shape and serves as a connecting medium fixed to an article to be heated. The above-mentioned heater element is generally made of the same as that set forth in the co-pending application. In the preferred embodiment, the heater element is in the form of a plurality of slim dovetail members or a sheet wrapped in close contact over the periphery of the core.

With the heater element in the above-mentioned form, the device can effectively heat corresponding portions of the article to be heated with the heat produced from the heater element emanating in a circular fashion from the core. Moreover, the circular heating device of this invention enables a constant source of heat to be applied to an item, for example, a soldering iron, even during use of such soldering iron. This device, therefore, provides these unexpected benefits not associated with heating elements of the prior art. It is believed such benefits are obtained because of the configuration of the heating elements about the device and the specific configuration of each element.

The heater element as above-described is durable, achieving a long useful life without deterioration by oxidation or chemical erosion owing to the fact that the heat-generating resistor pattern is hermetically sealed in a ceramic body.

It is therefore an object of the present invention to provide a ceramic heating device which is free from deterioration by oxidation and also which prevents chemical erosion, wherein a heat-generating means, namely, a heat-generating resistor pattern, is hermetically sealed inside a ceramic body.

It is another object of the invention to provide a heating device which is mechanically rigid and thermally stable.

Another object of the invention is to provide a heating device which is in the form of solid or hollow cylindrical shape and is easy to be connected to cylindrical article to be heated.

A further object of the invention is to provide a heating device in which heat-generating medium is formed in a thick film through a printing process.

Yet a further object of the invention is to provide a heating device which is excellent in radiation of a heat-generating medium.

It is an even further object of the invention to provide a heating device which can be manufactured at a low cost.

Other objects and advantages of the invention will become apparent from the following description of embodiments with reference to the accompanying drawings.

DETAILED DESCRIPTION OF THE INVENTION

Figure 1:
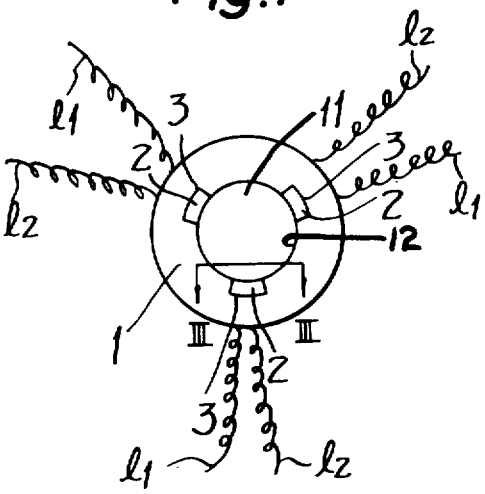
FIG. 1 is a top view of a ceramic heating device of the present invention.
Figure 2:
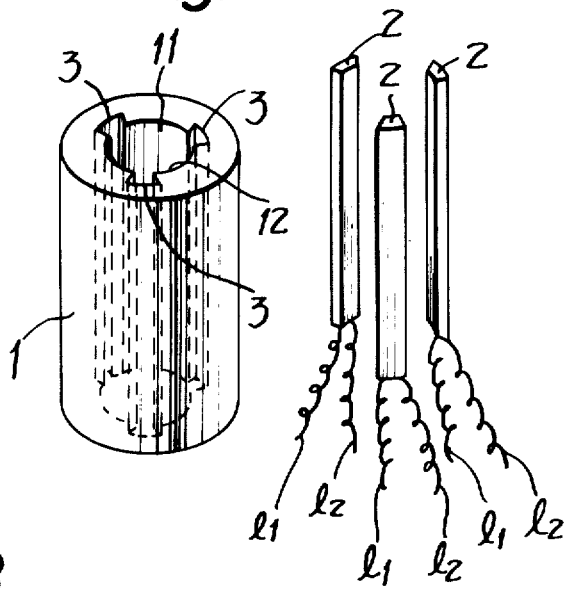
FIG. 2 is a disassembled perspective view of the device shown in FIG. 1.

Referring to the drawings, the heating device according to the invention comprises principally a burnt cylindrical support core 1 of heat-resistant ceramics and burnt heater element 2 made of heat-resistant ceramics disposed circumferentially around said support core 1. The constructional difference among the various examples shown in the drawing resides in the shape and number of the heater elements, and the associating manner in which the heater elements are placed on the support core 1.

In detail, heating elements 2 in the first and second examples (shown in FIGS. 1 and 6) are comprised of a plurality of heater tips of slim dovetail members having longer length in the longitudinal direction. These heater tips of slim dovetail members are adapted to be fixed in dovetail groove members 3 also having longer length in the longitudinal direction. The heater elements 2 and the support core 1 in these examples are burnt separately.

In the third example of the heater element (FIG. 8) the heater element 2 is shown as being a wrapped sheet around the periphery of the support core 1 and being burnt together with the support core 1 into one body, in which a heat-generating resistor is provided on the back side of the wrapped sheet in a predetermined pattern. The heater elements 2 in the fourth and fifth examples (FIGS. 12 and 16) are constructed as wrapped sheets similar to that in the third example but the wrapped sheets in these examples have no heat-generating pattern per se and the heat-generating resistor pattern is provided directly on the periphery of the support core 1.

Each example of the invention is fully described hereinafter wherein like reference characters designate like or corresponding parts throughout.

In the first and second examples (FIGS. 1 and 6, respectively), the ceramic support core is a hollow cylinder. In FIG. 1, the cylinder has the dovetail groove members provided along the inner wall or periphery of the support core, and in FIG. 6 the dovetail groove members are provided along the outer wall thereof. In FIGS. 1 to 5, showing the first example, the support core 1 is made of heat resistant ceramics such as alumina ceramics ($Al_2O_3$) and forsterite ceramics ($2MgO.SiO_2$). The core 1 is made in such a manner that the above-mentioned ceramic material is extrusion-molded from an extrusion die having a predetermined cross section and thereafter the extrusion-molded material is heated to be sintered at a predetermined sintering temperature. Such temperature being dependent upon the specific ceramic used. The dovetail-like ceramic heater elements 2 (to be fixed in the groove members 3) are made of heat resistant ceramics such as those used for the core 1 and have a heat-generating resistor pattern 22 disposed therein. Pattern 22 is applied with a highly resistive but conductive metal paste such as Mo-Mn paste, W paste, etc. (hereinafter referred to as resistor paste). As shown in FIG. 4, the element 2 is made such that first on a heat resistant ceramic substrate 21 (green sheet or burnt sheet) the heat-generating resistor pattern 22 is formed in a thick film of which thickness, width, shape and length are specifically selected and in which a "reverse U shape" is preferred embodiment. This is done so that the desired heat-generating resistor value can be obtained through printing process using the above-mentioned resistor paste. Then, on the above-mentioned substrate 21 having the resistor pattern 22, a ceramic overlay 23 is provided in the form of ceramic green sheet made of the same or similar material as that of the substrate 21, or in the form of coat laying according to a coating method such as screen method, dipping method, spraying method using slurry or paste which is adjusted with organic binder and solvent mixed with the ceramic material. Finally, the ceramic materials thus combined are sintered into one uniform body heated at a sintering temperature of the ceramics used.

In the above construction, a pair of exposed terminals 24,24 to be connected to the resistor pattern 22 are provided through printing at one end of the substrate 21 using the above-described resistor paste, and to the terminals are respectively connected a pair of leads $l_1$ and $l_2$. It is also possible in forming the terminals 24, 24 that the through-hole passing through the overlay 23 or the substrate 21 is provided either in the overlay 23 or in the substrate 21 and in the through-hole of which is filled with the resistor paste and at the end thereof, namely, on the outer surface of the overlay 23 or the substrate 21 are provided exposed terminals 24, 24 printed by the resistor paste.

Figure 3:
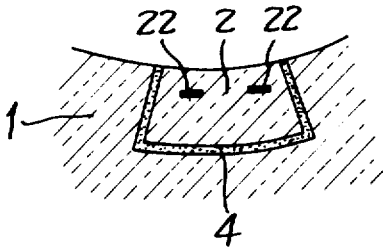
FIG. 3 is a cross-sectional view taken along line III—III of FIG. 1 showing the heating elements imbedded in the ceramic case.
Figure 4:
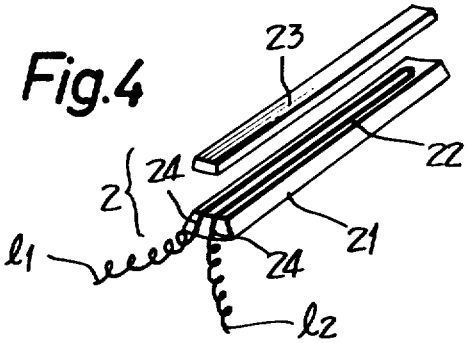
FIG. 4 is a perspective view partially broken away of a heater element of the present invention which has been removed from the core member.

The structure of the fitting between the dovetail groove members 3 of the support core 1 and the heater element 2 is shown in FIG. 3. Note that the groove members 3 are formed along the inner wall 12 adjacent the central opening 11. The dovetail groove member 3 may fit with the heater element in such a manner that alumina cement ($Al_2O_3$) 4 is applied in the inner surface of the groove member 3 and the heater element 2 is inserted along the longitudinal direction of the groove member 3 to be fitted thereto by cementation of the cement 4. Thermoplastic resin may be adopted as a substitute for the cement to adhere the heater element 2 to the groove member 3. Alternatively, metalization may be applied on the groove member 3, such as, for example, nickel plating, while metal is in the same way applied on the surface of the heater element 2. Thereafter, brazing the groove member 3 and the heater element 2 respectively through metal brazing material also leads to cementing of elements 2 in grooves 3. Leads $l_1$, $l_2$ of the terminals 24, 24 of each element 2 is made in parallel connection respectively to AC or DC power source (not shown in the drawings). In the preferred embodiment, because of the heat generating characteristics of the resistor paste, the power source should not be of high voltage.

Figure 5:
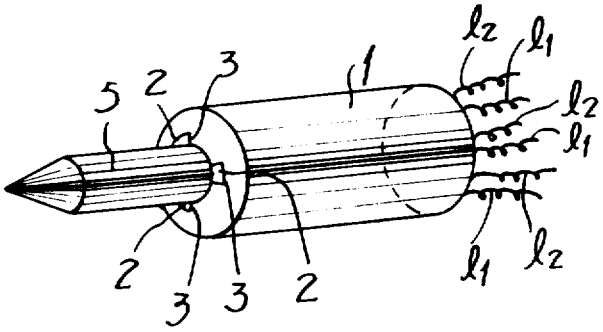
FIG. 5 is a perspective view showing the application manner of the device shown in FIG. 1.

FIG. 5 illustrates how the device thus produced is used. In a hollow 11 of the core 1 is fixed a cylindrical article 5 to be heated, namely, a tip of soldering iron. In this case, if AC or DC power is supplied to the heat-generating pattern 22 in each of the above-mentioned heater element 2, Joule's heat produced at each element 2 is conducted from the outer wall of the article 5 to be heated directly to the centripetal direction thereof so that the article is efficiently heated at a desired temperature. The quantity of heat produced or heating time to have the desired temperature varies with shape, number of the element 2, and shape, electric conductivity of the pattern 22. However, heating to the desired temperature can be obtained in rather a short time and small power consumption because of the circular pattern of the elements 2.

In a second example of the device (FIG. 6), similar to the above-described example, the same number and same shape of dovetail groove member 3 as in the first example are provided along the outer wall 13 of the hollow cylindrical support core 1 and in the dovetail groove members 3 are fitted heater elements 2 having the same construction as that of the first example, and in the same way.

Figure 6:
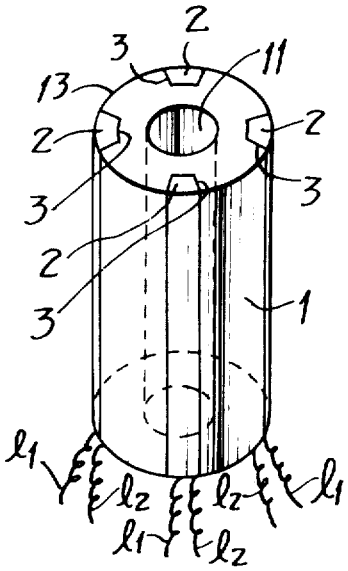
FIG. 6 is a perspective view of the second example of the present invention in which the heater elements are disposed along the outer periphery of the core.

In the first example (FIG. 5), the dovetail groove members 3 are provided on the outside of the core 1 along the periphery thereof where the article 5 to be heated is positioned on the outside of the core 1 with the hollow 11 forming a connecting medium with the device including the article 5 to be heated. However, if the hollow 11 does not necessarily function as a connecting medium so as to fix the rod provided at the article in the hollow 11, the dovetail groove members 3 may be provided along the periphery 13 of the cylindrical support core (FIG. 6). Consequently, the position of the dovetail groove members 3 may be selected suitably by the relative relation thereof with the article 5 to be heated and the position of the core 1 may be preferably determined with reference to the relative relation of the attachment thereof with the device including the article 5 to be heated.

With some device having specific articles 5 to be heated, some ceramic heater in which heater element 2 is fixed both to the periphery 13 and the inner wall 12 along the hollow 11, in the case of the hollow cylindrical support core 1, is also within the scope of this invention.

Figure 7:
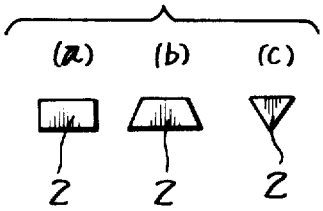
FIG. 7 are plan views of heater elements showing various shapes such elements may have.

Therefore, the transverse cross-section of the support core 1 may be in the shape of square pillar, hollow square cylinder or some other shapes (not shown) and similarly the shape of the heater elements 2 of rectangular shape, trapezoid shape or triangle or some other shape as shown in FIG. 7A, B and C. Accordingly, the dovetail shape shown in the drawings may be adopted with regard to the corresponding shape of the dovetail groove member 3 and the position and number of the grooves 3 may be selected from other than those shown in the drawings.

As described in the device of the first and second examples, the resistor pattern 22 is hermetically sealed in the heater element 2 of the ceramic material so as to produce Joule's heat under the conditions that exposure to the air is completely shut out so that deterioration by oxidation and erosion under other erosive environment are removed of the pattern 22 making it possible to achieve a long, useful life. Also, since the heater element 2 is not subjected to any bending process in the course of manufacturing, there is no fear of causing disconnection or cracking by heating of the pattern 22. This enables the heater element to produce a constant quantity of heat. Furthermore, since the heater element 2 is held by the core 1, the core 1 is substantially durable with respect to the constructional material against the external force limiting mechanical damage of the element 2 in use thereof, i.e. the whole structure is rigid.

Figure 8:
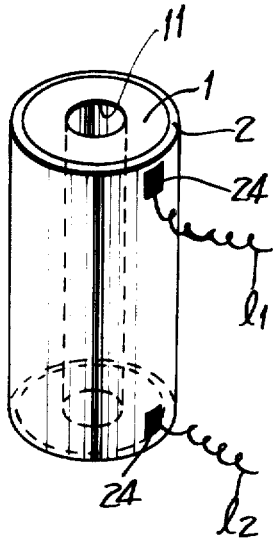
FIG. 8 is a perspective view of a third type heater element of a circular variety.
Figure 9:
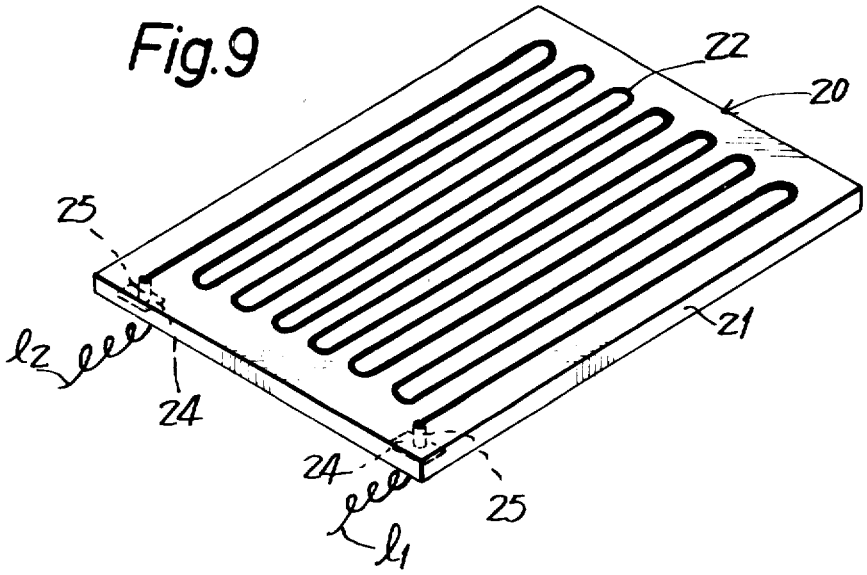
FIG. 9 is a perspective view of the heater element shown in FIG. 8 prior to its being wrapped about the core member.
Figure 10:
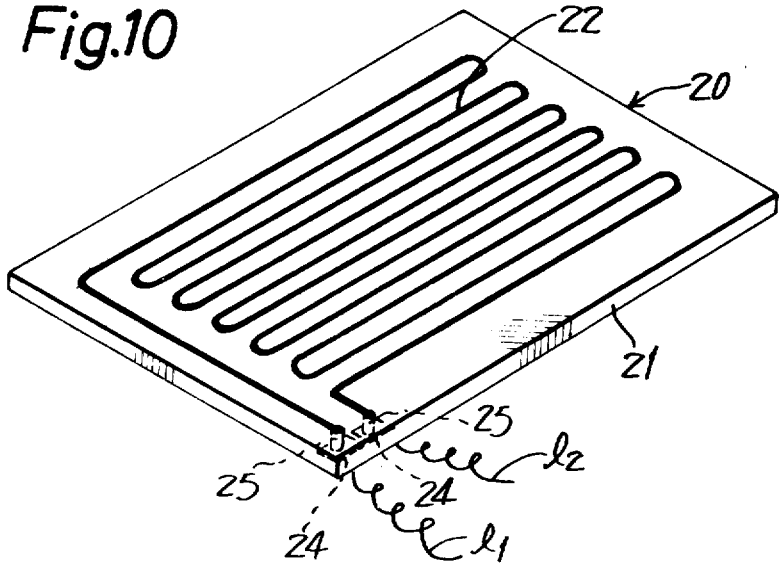
FIG. 10 is a perspective view of a second heater element which may be wrapped above the coil as indicated in FIG. 8.

In the third example (FIGS. 8–10), the heater element is adapted as a wrapped sheet around the support core. In FIG. 8, the hollow cylindrical support core 1 is the same as that in the former examples. Numeral 2 denotes a ceramic heater element of cover sheet which is wrapped on the periphery of the core and then sintered with the core into one body. In this example, the heat-generating resistor pattern is printed on the back side of the wrapped sheet. Namely, in this example, around the periphery of the support core 1 which is extrusion-molded of ceramics of the above-mentioned ceramic materials, a heater element 20 of ceramics is applied substantially without leaving any gap between the core 1 and the element 20. The heater element 20, as shown in FIG. 9, is comprised of a substrate 21 of heat-resistant ceramic green sheet and a heat-generating resistor pattern 22 printed thereon through the above-referenced printing method. The thickness, width and length of the pattern 22 being suitably selected for obtaining desired thermal resistive value (zigzag is shown in the drawing). In conjunction with the formation of the heat-generating resistor pattern 22, at an adequate position on the substrate 21, there are provided through-hole connecting means 25, 25 leading to the pattern 22. On the front surface of the substrate 21 are printed a pair of exposed terminals 24 by the same printing method as that of resistor patterns. FIGS. 8 and 9 show the exposed terminals 24, 24 provided at the distal ends of the ceramic heater element 20 in the longitudinal direction thereof or alternatively they may be applicable such that one end of the above-mentioned pattern 22 is extended up to the other end of the pattern 22 as shown in FIG. 10. The crude ceramic heater element 20 thus obtained is wrapped around the periphery of the above-mentioned core 1. The element 20 and the core 1 are then heated to the sintering temperature of the ceramics used to be burnt into one body. Finally, a pair of leads $l_1$, $l_2$ are connected by brazing to the above-mentioned terminals 24, 24 whereby the ceramic heater element 2 is obtained. The shape of the pattern 22 is not limited to zigzag but wave-like comb or other desired shapes are also within the scope of this invention.

Figure 11:
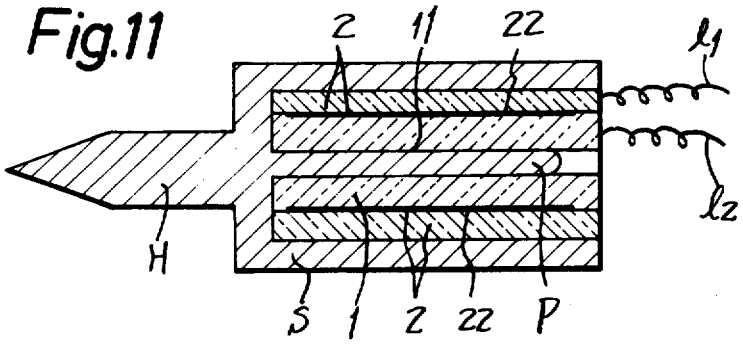
FIG. 11 is an axial cross-sectional view of FIG. 5 showing the internal aspect of the device.

An application manner of the device in this third example is shown in FIG. 11. At the end of the tip H of a soldering iron is formed a cylindrical sleeve having one end closed and a pin $p$ in the central core of the sleeve $s$. Through the sleeve $s$, the heater of this example is set with the pin $p$ inserted in the hollow 11 of the support core 1. When AC or DC power is supplied through leads $l_1$, $l_2$, the heat-generating resistor pattern 22 in contact with the peripheral surface of the core 1 is heated, the heat of which is conducted from the sleeve to the tip H of the soldering iron so as to heat it at a desired temperature. In this case, owing to the heat-generating characteristic of the resistor paste, comparatively small power consumption is required and heating to a desired temperature in a shorter time is achieved. The hollow 11 in this example also functions as a kind of a connecting medium but with the construction of some articles to be heated which mate with the hollow 11, the hollow 11 need not provide the core 1 with a simple solid cylindrical body as in the former examples.

In the device of this example, the heat-generating resistor pattern 22 produces Joule's heat under the conditions where it is hermetically sealed in the ceramic heater completely preventing exposure thereof to the air. This prevents deterioration by oxidation of the heat-generating resistor pattern or erosion under some erosive environment and provides longer useful life thereof. Moreover, wrapping the periphery of the core with the heater element enables larger quantity of heat to be obtained. And since the core 1 and the heater element 2 are sintered into one body, the device is of high strength and substantially resistive to the physical external force. In this example, the heater element 2 is made by wrapping sheet material thereof around the periphery of the core material 1 and binding it thereover. It is preferable to select the core 1 of larger radius rather than the one of too small radius in consideration of removing the fear of disconnection of the heat-generating resistor pattern 22 in the heater.

Figure 12:
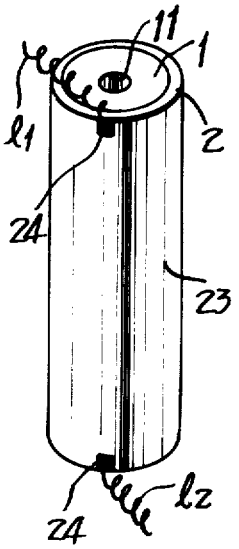
FIG. 12 a perspective view of another example of the heating element and core configuration.
Figure 13:
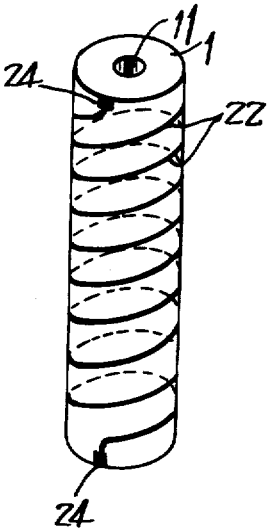
FIG. 13 is a perspective view showing a heat-generating resistor pattern on the surface of the support core shown in FIG. 12.
Figure 14:
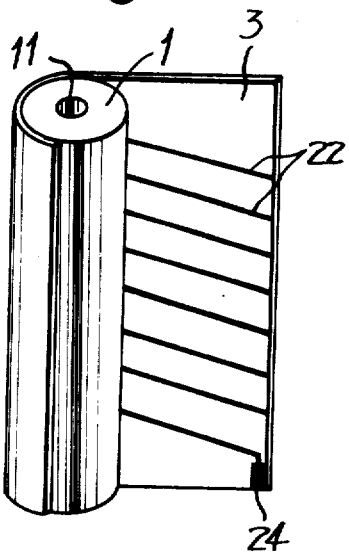
FIG. 14 is a perspective view showing the manner of transfer printing method used to produce the device shown in FIG. 13.
Figure 15:
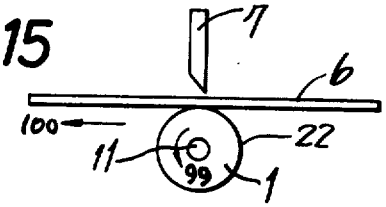
FIG. 15 is a front view showing another process of applying the resistor pattern to the core.
Figure 16:
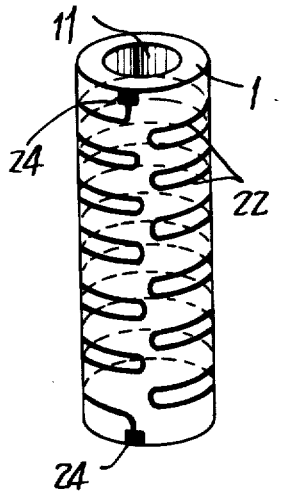
FIG. 16 is a perspective view of a support core with another heat-generating pattern.
Figure 17:
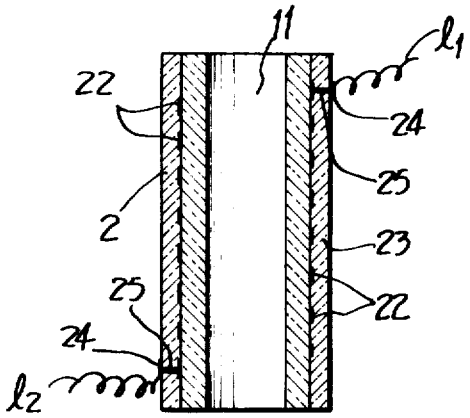
FIG. 17 is a cross-section showing the connection of the heat-generating pattern shown in FIG. 16 and the exposed terminals thereof.

The heater elements 2 in the fourth and fifth examples (FIGS. 12 and 16, respectively) are constructed in such a manner that on the heat-generating resistor pattern printed directly on the periphery of the support core is wrapped a ceramic overlay. In FIGS. 12 to 14, which show the fourth example, the support core 1 is the same as in the former examples. However, the heat-generating resistor pattern 2 in this example is provided around the periphery of the core 1 through transfer printing method or curved surface printing method (refer to FIG. 13) and a ceramic overlay 23 is wrapped and laminated on the periphery of the core 1. Thereafter, the resistor pattern 2 and the ceramic overlay 23 finished with the above-mentioned processes are sintered with the core 1 thereby constructing the heater element 2. In the above-mentioned construction, at the distal ends of the pattern 22, a pair of exposed terminals 24, 24 adapted to be electrically connected to the heat-generating resistor pattern 22 are printed through a printing process in use of the same resistor material on the core 1. The above-mentioned transfer printing method is that of the known art adapted for ceramic- and china-ware. In this example, the resistor pattern 11 is printed again on a transfer sheet 3. To the periphery of the above-mentioned core 1 (crude or sintered) is then wrapped such that the transfer sheet 3 has the printed side adjacent to the outer surface of the core 1. In the curved surface printing method as shown in FIG. 15, the core 1 is rotated in the direction of the arrow 99 while the screen 6 is slided in the direction of the arrow 100 over the core 1. The resistor paste is coated and printed on the periphery of the core 1 by the pressure of a squeezer 7 so as to obtain the resistor pattern 22 on the surface of the core 1. Numeral 23 in FIG. 12 denotes a heat-resistant ceramic overlay which is laminated on the periphery of the heater element inclusive of the above-mentioned pattern 22. The lamination is effected in such a manner that in the case of a core 1 of crude material, overlay 23 is applied through spray process or dipping process using a ceramic slurry which is adjusted with organic binder and solvent mixed with the ceramic material. Overlay 23 may also be wrapped about core 1 and use the same ceramics as of the core 1. Overlay 23 may also be made of green sheet of ceramics having thermal characteristics similar to core 1. If lamination is made through the above-mentioned spray process or dipping process, thinner film can be obtained compared with wrapping the green sheet; this also improves the heat radiation of the pattern 22 and prevents cause of cracks of the overlay 23 due to thermal contraction. In the case where the core 1 is predeterminately sintered, the overlay 23 is wrapped to be formed only through the above-mentioned spraying process or dipping process. As described above, on the periphery of the ceramic heater element 2 inclusive of the pattern 22 is applied the overlay 23 by laminating coat layer through spraying or dipping process or wrapping the green sheet and the core 1 of the heater element 2 and overlay 23 are sintered into one body by heating them to the sintering temperature of the ceramics used. A pair of leads $l_1$, $l_2$ are then led out of the above-mentioned terminals 24, 24. As for the terminal forming process, in the case of coat overlay 23, a masking process is adopted so as not to cover the terminals 24, 24. In the case of the green sheet laminated overlay 23, cut-out portions are formed on the overlay 23 from which cut out portions form the exposed terminals. Further, the lower side terminals 24, 24 may be extended by interposing the resistor paste such as Mo-Mn and W coated to the cut-out portions. The configuration of the resistor pattern 22 may be a zigzag one provided along the axis of the core 1 as shown in FIG. 16. The exposed terminal 24 may be so constructed that as shown in FIG. 17 where the terminals 24, 24 are formed on the outer surface of the overlay 23 not on the periphery of the core 1. In this embodiment, terminals 24, 24 are electrically connected by being passed through holes 25, 25.

Figure 18:
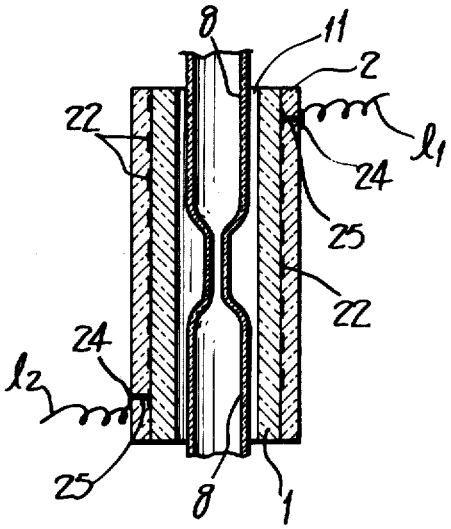
FIG. 18 is a longitudinal cross-section showing the manner of application of the device shown in FIG. 12.

An application manner of this fifth example is shown in FIG. 18. This figure shows the case of heating a length of glass tube 8 at its halfway point to melt and seal it. Such a process has special utility in manufacturing electric bulb in which the glass tube 8 to be sealed is inserted in the hollow 11 of the device of the invention so that the overall periphery of the portion of the tube 8 to be sealed is melted. In this case, the tube is efficiently heated from the periphery thereof by the heat of the heat-generating resistor pattern 22 and is effectively sealed.

In the device of this example, as above described, the pattern 22 is hermetically sealed in the ceramic heater so that deterioration by oxidation or erosion by other erosive environment of the pattern is removed thereby achieving longer useful life thereof. In the preferred process for this example, the pattern 22 is printed through printing method such as transfer printing method and curved surface printing method by screen, in use of conductive paste, over the tubular or pillar like core 1 so that the fear of disconnection of the heat-generating resistor pattern 22 is substantially removed and the radius of the core can be made smaller compared with the process used in the third example in which over the substrate of the green sheet of heat-resistant ceramic is printed the pattern to be bent and wrapped around the tubular or pillar like ceramic core.

While the invention has been described by way of the examples discussed herein, it will be understood that various modifications may be made therein and it is intended to cover in the appended claims all such modifications as fall within the true spirit and scope of the invention. For example, the support core and the heater element may be made of the same or different ceramic materials selected from the group of alumina ceramics, beryllium oxide ceramics, cordierite ceramics, zircon ceramics, mullite ceramics and celsian ceramics, or of different ceramic materials which are selected from the combination group of alumina ceramics-beryllium oxide ceramics, cordierite ceramics-zircon ceramics, cordierite ceramics-mullite ceramics, cordierite ceramics-celsian ceramics and zircon ceramics-mullite ceramics.

We claim:

1. A cylindrical ceramic heating device comprising:

a burnt cylindrical support core of heat resistant ceramics;

at least one burnt heater element made of heat resistant ceramics disposed around said support core in contact with the periphery of said support core, said element comprising a burnt sheet of heat resistant ceramics;

a heat-generating electrical resistor pattern formed from a resistive paste and fired on said ceramic sheet, said pattern being hermetically sealed between said sheet and said core; and a pair of exposed terminals disposed on said sheet, said terminals being connected to said pattern and adapted to be coupled to power leads such that electrical power is applied to said pattern; said support core being a hollow cylinder and the hollow thereof being adapted to form a means to connect with a cylindrical article to to heated.

2. The ceramic heating device as claimed in claim 1 wherein said burnt sheet is a wrapped sheet around the outer surface of said support core and is sintered with said support core into one body, and said heat-generating resistor pattern is provided on the back side of said wrapped sheet in contact with the outer surface of said support core.

3. The ceramic heating device as claimed in claim 2 wherein said support core and said wrapped sheet are both made of a heat-resistive ceramic material as a starting material and both are sintered into one discrete body.

4. The ceramic heating device as claimed in claim 2 wherein said pair of exposed terminals are provided on the front surface of said wrapped sheet and are connected to each other by said heat-generating resistor pattern on the back surface of said wrapped sheet; and a through-hole connecting means passing through the thickness of said wrapped sheet is provided with said terminals passing therethrough.

5. The ceramic heating device as claimed in claim 1 wherein said support core and said heater element are made of the same ceramics selected from the group consisting of alumina ceramics, beryllium oxide ceramics, cordierite ceramics, zircon ceramics, mullite ceramics and celsian ceramics.

6. The ceramic heating device as claimed in claim 1 wherein said support core and said heater element are made of different ceramics which are selected from the combination group of alumina ceramics-beryllium oxide ceramics, cordierite ceramics-zircon ceramics, cordierite ceramics-mullite ceramics, cordierite ceramics-celsian ceramics and zircon ceramics-mullite ceramics.

7. The ceramic heating device as claimed in claim 1 wherein said heat-generating resistor pattern comprises a material selected from the group consisting of W, Mo, Mo—Mn and Pt.

8. The ceramic heating device as claimed in claim 1 wherein said terminals are made of the same material as said heat-generating resistor pattern.

* * * * *